US006231092B1

(12) United States Patent
Shields et al.

(10) Patent No.: US 6,231,092 B1
(45) Date of Patent: May 15, 2001

(54) PORCELAIN KNOB CONSTRUCTION

(75) Inventors: Peter Shields, Donvale; Daryl Kennedy, Research; Alan Roy Wilton, Huntingdale, all of (AU)

(73) Assignee: Gainsborough Hardware Industries Limited, Blackburn (AU)

( * ) Notice: Subject to any disclaimer, the term of this patent is extended or adjusted under 35 U.S.C. 154(b) by 60 days.

(21) Appl. No.: 08/942,618

(22) Filed: Oct. 2, 1997

(30) Foreign Application Priority Data

Oct. 24, 1996 (AU) ..... 03195

(51) Int. Cl.[7] ..... E05B 1/00
(52) U.S. Cl. ..... 292/347; 292/348
(58) Field of Search ..... 292/347, 348, 292/349, 355

(56) References Cited

U.S. PATENT DOCUMENTS

| | | | | |
|---|---|---|---|---|
| 192,759 | * | 7/1877 | Haines | 292/347 |
| 231,903 | * | 9/1880 | Dougherty | 292/347 |
| 818,565 | * | 4/1906 | Schwarz | 292/347 |
| 993,298 | * | 5/1911 | Henry | 292/348 |
| 1,186,234 | * | 6/1916 | Sanderson | 292/347 |
| 1,687,531 | * | 10/1928 | Verse | 292/347 |
| 1,798,409 | * | 3/1931 | Ferris | 292/348 |
| 1,919,455 | * | 7/1933 | Wilson | 292/347 |
| 2,061,811 | * | 11/1936 | Sinko | 292/347 |
| 3,024,555 | * | 3/1962 | Abeles | 292/347 |
| 5,190,327 | * | 3/1993 | Lin | 292/348 |
| 5,688,005 | * | 11/1997 | Ellis | 292/348 |
| 5,749,612 | * | 5/1998 | Meck et al. | 292/347 |

FOREIGN PATENT DOCUMENTS

| | | |
|---|---|---|
| 406014 | 2/1934 | (GB) . |
| 2203641 | 10/1988 | (GB) . |

* cited by examiner

*Primary Examiner*—Teri Pham Luu
(74) *Attorney, Agent, or Firm*—Sughrue, Mion, Zinn, Macpeak & Seas, PLLC

(57) ABSTRACT

A porcelain knob construction comprising a metal mounting member which is adhered to a porcelain knob (101) comprising a body with a shaft (105) protruding therefrom. The shaft is hollow and has a blind hole (104) formed in the free end thereof. The mounting member includes an annular recess (108) to receive the free end of the shaft (105). The mounting member and shaft (105) are adhered only adjacent the shaft free end whereby the interior of the blind hole (104) is substantially free of adhesive.

9 Claims, 3 Drawing Sheets

PORCELAIN KNOB CONSTRUCTION

FIELD OF THE INVENTION

The present invention relates to knobs and, in particular, to porcelain knobs for use with either cupboards or doors.

BACKGROUND OF THE INVENTION

Porcelain knobs have long found favour because of their appearance and find use either as fixed knobs for cupboards or as rotating knobs for doors. The porcelain knob itself has a bulbous body which is shaped to be conveniently grasped and a shaft protrudes from the body. The shaft is hollow having a blind hole formed in its free end and a metal mounting member is secured by adhesive to the shaft. The adhesive has substantially filled the shaft hitherto.

Such a conventional knob construction suffers from the disadvantage that in the event that there is an excessive load applied to the knob, the knob is liable to fracture in the region where the knob shaft joins the bulbous body. This is undesirable for various reasons, including that in the customer's mind, a precise component should not fail and that the end result is very unsightly.

It is the object of the present invention to provide an improved porcelain knob construction in which the mechanism of failure, if any, is improved.

DISCLOSURE OF THE INVENTION

In accordance with the present invention there is disclosed a porcelain knob construction comprising a metal mounting member which is adhered to a porcelain knob comprising a body with a shaft protruding therefrom, said shaft being hollow and having a blind hole formed in the free end thereof, wherein said mounting member includes an annular recess to receive said free end of said shaft and wherein said mounting member and shaft are adhered only adjacent said shaft free end whereby the interior of said blind hole is substantially free of adhesive.

BRIEF DESCRIPTION OF THE DRAWINGS

Two embodiments of the present invention will now be described with reference to the drawings in which.

PREFERRED EMBODIMENTS OF THIS INVENTION

Figure 1:
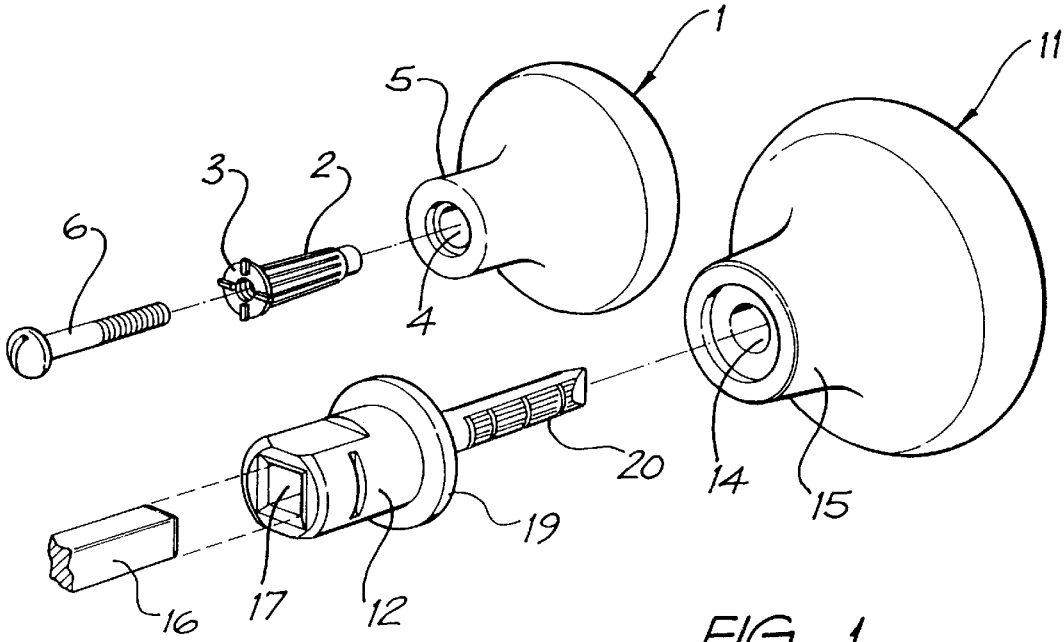
FIG. 1 PRIOR ART
FIG. 1 an exploded perspective view showing the prior art arrangements for fixed cupboard knobs and rotating door knobs, respectively.

As seen in FIG. 1, a cupboard knob 1 and a door knob 11 of conventional construction are illustrated together with their associated mounting hardware. For the cupboard knob 1, the mounting member takes the form of an internally threaded sleeve 2 which has a flange 3 at one end and which is adhered by means of epoxy adhesive, or similar, into the hollow interior 4 of a shaft 5 formed on the knob 1. A threaded fastener 6 which mates with the sleeve 2 completes the mounting hardware.

The arrangements of the door knob 11 are essentially similar in that the knob itself is provided with a shaft 15 having a hollow interior 14 which again forms a blind hole. The door latching mechanism is provided with a square spindle 16 which is received in a corresponding square cavity 17 in a sleeve 12. The sleeve 12 has a flat annular flange 19 from which protrudes a shank 20 which is glued into the hollow interior 14.

Figure 2:
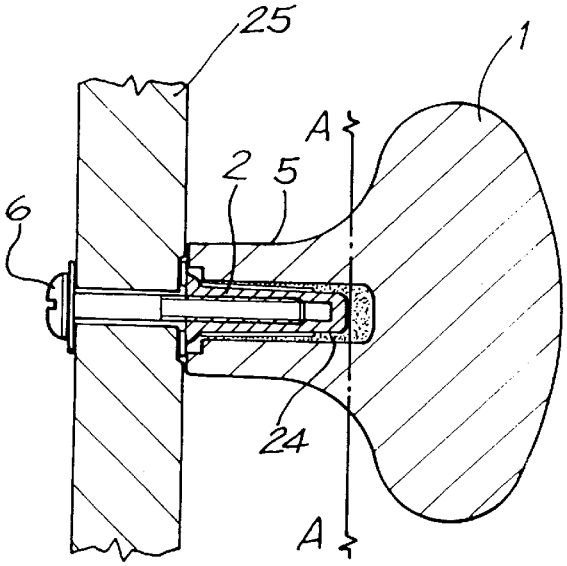
FIG. 2 PRIOR ART
FIG. 2 is a cross-sectional view through a prior art cupboard knob prior to failure.
Figure 3:
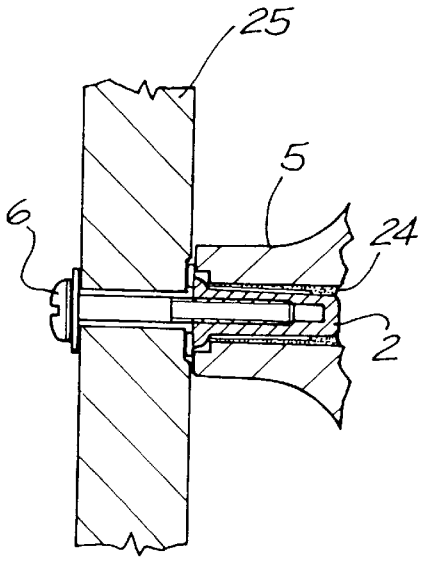
FIG. 3 PRIOR ART
FIG. 3 is a view similar to FIG. 2, but showing the result after failure.

FIGS. 2 and 3 illustrate the prior art arrangement for the cupboard knob 1, however, it will be apparent to those skilled in the art that the arrangements for the prior art door knob 11 are essentially equivalent. The sleeve 2 is glued to the hollow interior 4 and the entire space between the sleeve 2 and the interior of the shaft 5 is filled with adhesive 24. This securely binds the sleeve 2 to the knob 1 and enables the threaded fastener 6 to be passed through the cupboard door 25 and mate with the sleeve 2. In the event of a failure, the cupboard knob 1 breaks approximately along the line A—A of FIG. 2 to create the situation illustrated in FIG. 3.

It is thought that a contributing factor towards this mode of failure is that the adhesive 24 contributes to a strengthening of the shaft 5. As a consequence, the line of fracture is located approximately in the position of the line A—A of FIG. 2.

Figure 4:
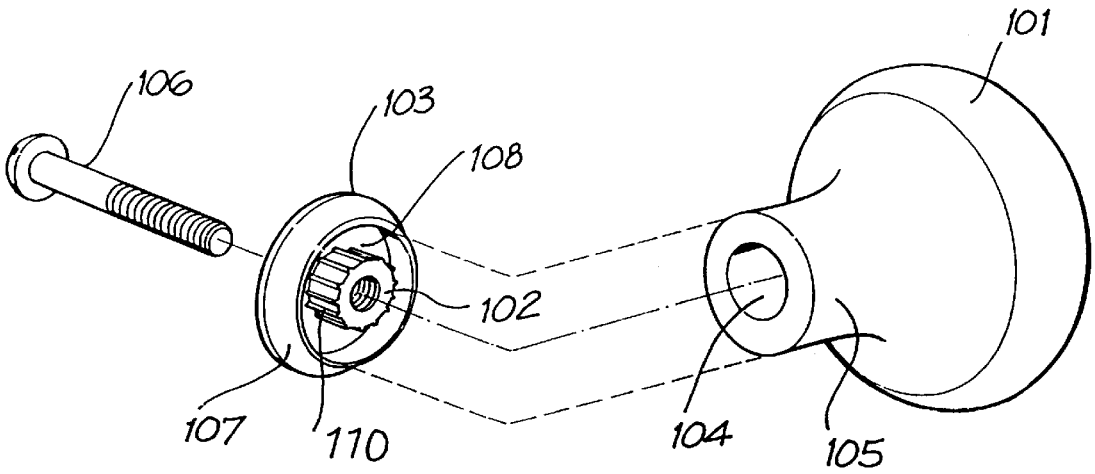
FIG. 4 is an exploded perspective view of a cupboard knob in accordance with the first embodiment of the present invention.

Turning now to FIG. 4, in the embodiments of the present invention to be described, the same numbering scheme will be used as in the numbering of the prior art equivalent components, save that the number will be increased by 100. Thus, FIG. 4 illustrates in exploded view the cupboard knob 101 of the preferred embodiment which has a shaft 105 and hollow interior 104 forming a blind hole, essentially as before. The previous flange 3 has been expanded to form a flange 103 and the previous sleeve 2 has been shortened into an internally threaded boss 102. A peripheral lip 107 on the knob side of the flange 103 forms an annular recess 108 which snugly receives the free end of the shaft 105.

In the preferrred form shown, the boss 102 extends into less than 25% of the depth of the hollow interior 104.

Figure 5:
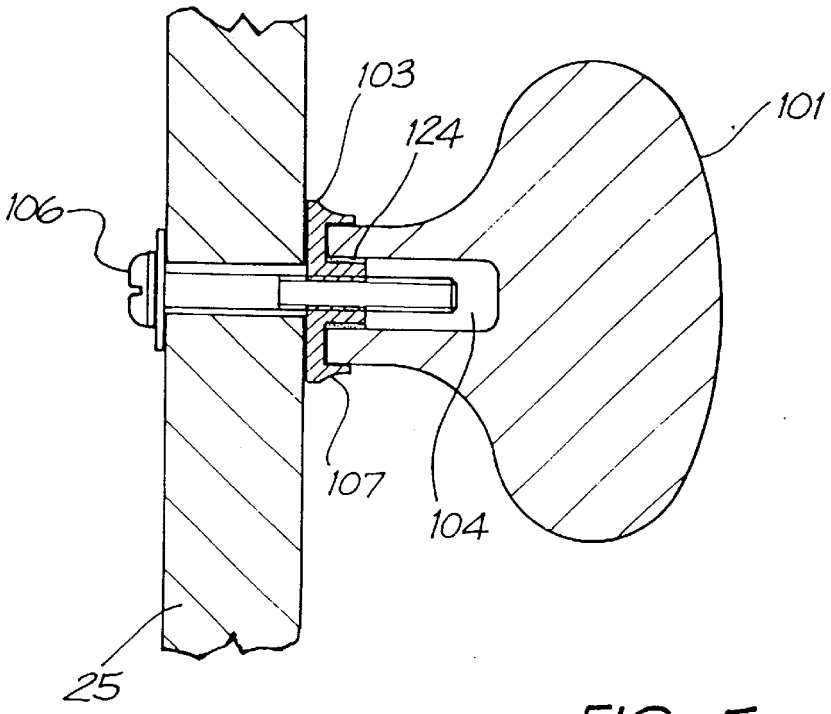
FIG. 5 is a cross-sectional view similar to FIG. 2, but showing the cupboard knob of FIG. 4.

The position following mounting of the knob 101 to the cupboard door 25 is illustrated in FIG. 5. It will be seen that the threaded fastener 106 passes through the boss 102. The hollow interior 104 is of sufficient depth to accommodate either different length fasteners 106, or different thicknesses of the different cupboard doors 25.

However, as seen in FIG. 5, the adhesive 124 used to glue the flange 103 and shaft 105 together, is only applied immediately adjacent the free end of the shaft 105. Thus the hollow interior 104 is substantially free of adhesive 124, except immediately adjacent the free end of the shaft 105.

The boss 102 includes a series of raised protuberances 110 to improve the adhesion between the boss 102 and the shaft 105.

Figure 6:
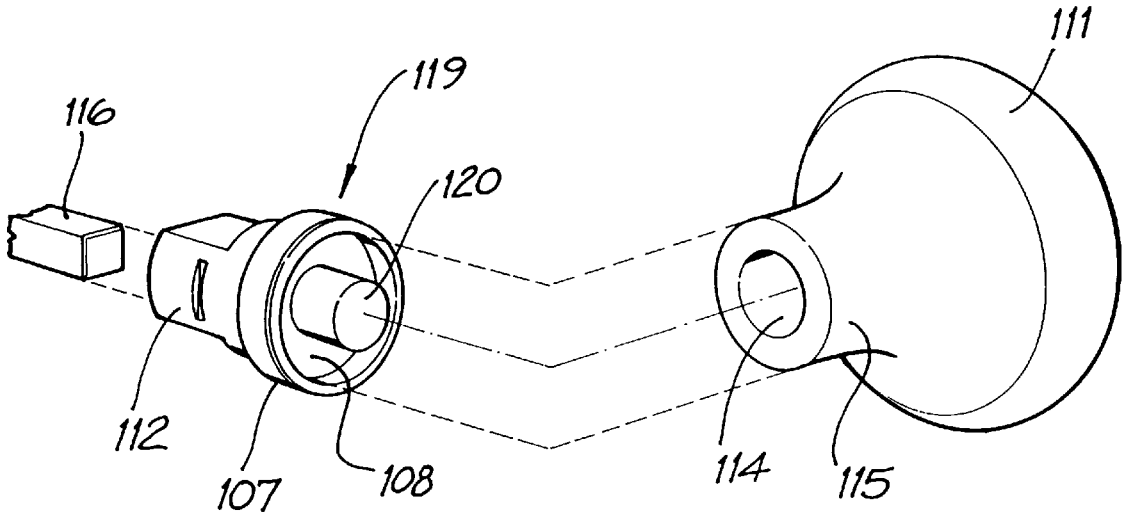
FIG. 6 exploded perspective view similar to that of FIG. 4, but illustrating the door knob of the second embodiment.
Figure 7:
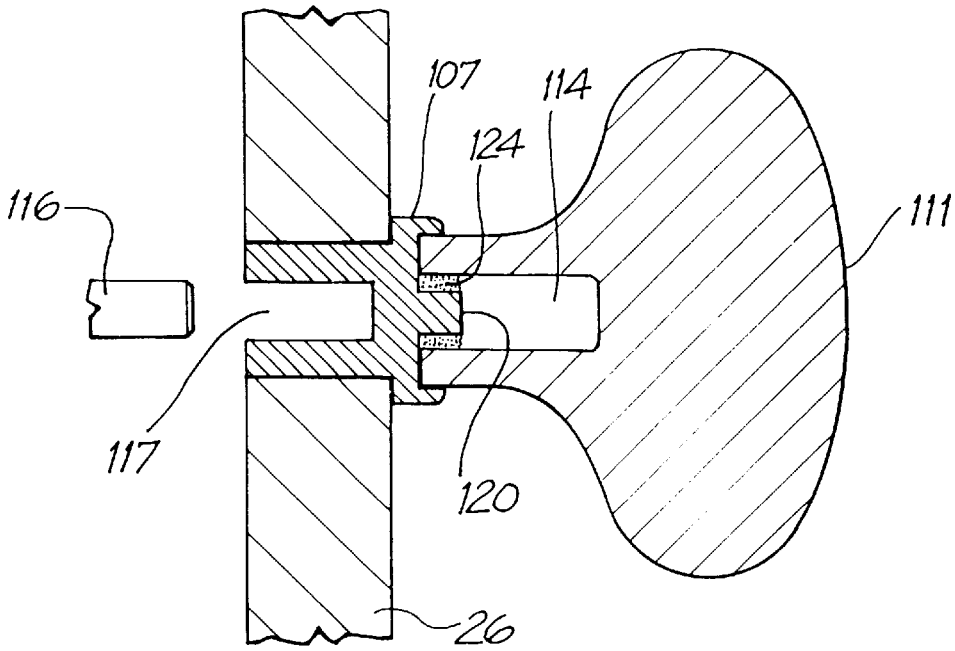
FIG. 7 is a cross-sectional view similar to FIG. 5, but illustrating the door knob of FIG. 6.

Turning now to FIGS. 6 and 7, it will be seen that the door knob 111 is substantially as before with its hollow interior 114 and shaft 115. The out-of-round (ie. square) spindle 116 is also as before.

However, whilst the sleeve 112 and cavity 117 are as before, the shank 120 is substantially shortened and the flange 119 is provided with a peripheral lip 107 which forms an annular recess 108 together with the shank 120. The mounting of the door knob 111 on the door 26 is illustrated in FIG. 7 from which it will be seen that adhesive 124 again is only positioned within the annular recess 108 and therefore only adheres to the free end of the shaft 115. The hollow interior 114, except adjacent the free end of the shaft 115, is substantially free of adhesive 124.

Experimental tests to date with the two above described embodiments indicate that failure of the knob construction only occurs at loads greater than those at which failure of the prior art arrangements occurred. Furthermore, in the event that failure does occur, one mode of failure is for the adhesive 24,124 to release its grip on the free end of the shaft 105,15. Since the failure is not of a precise component, the purchaser or user tends to blame the adhesive rather than the manufacturer and may even attempt to re-glue the knob 101 or 111 back into the annular recess 108. This attempt will generally be unsuccessful since the gluing procedures adopted by home handymen are generally insufficient for such loads. However, the purchaser or user under such circumstances is thought likely not to be deterred from re-purchasing a knob construction manufactured by the original manufacturer.

The foregoing describes only two embodiments of the present invention and modifications, obvious to those skilled in the art, can be made thereto without departing from the scope of the present invention. For example, the knob construction can be provided with a decorative washer or annular flange which surrounds the shaft 105,115 and is located between that shaft and the cupboard door 25 or door 26.

What is claimed is:

1. A porcelain knob construction comprising a metal mounting member which is adhered by an adhesive to a porcelain knob comprising a body with a shaft protruding therefrom, said shaft being hollow and terminating in a free end and having a blind hole formed in said free end, wherein said mounting member includes an annular recess to receive said free end of said shaft at an overlapping region and wherein said mounting member and shaft are adhered by said adhesive only adjacent said free end at said overlapping region whereby the interior of said blind hole remote from said overlapping region is substantially free of adhesive.

2. A construction as claimed in claim 1 wherein said mounting member includes a boss protruding partially into said blind hole and adhered thereto.

3. A construction as claimed in claim 2 wherein said boss extends into less than 25% of the depth of said blind hole.

4. A construction as claimed in claim 2 wherein said mounting member includes a peripheral lip around said boss, the outer surface of said shaft free end being snugly received within an inner edge of said lip.

5. A construction as claimed in claim 2 wherein said boss includes at least one outwardly facing gripping protuberances to improve adhesion between said boss and said blind hole.

6. A construction as claimed in claim 1 wherein said mounting member includes an internally threaded bore extending through said boss.

7. A cupboard door knob assembly comprising the porcelain door knob construction as claimed in claim 1 and a threaded fastener to fasten said door knob construction to a cupboard door.

8. A construction as claimed in claim 2 wherein the mounting member includes a sleeve extending away from said boss, said sleeve having an out-of-round blind hole to engage a spindle of corresponding cross-section.

9. A construction as claimed in claim 8 wherein said sleeve blind hole is of substantially square cross-section blind hole and said spindle is of substantially square cross-section.

* * * * *